US005649443A

United States Patent [19]

Shiroza et al.

[11] Patent Number: 5,649,443

[45] Date of Patent: Jul. 22, 1997

[54] TRANSFER FEEDER

[75] Inventors: Kazuhiko Shiroza; Kiyokazu Baba; Kenji Nishida, all of Komatsu, Japan

[73] Assignee: Kabushiki Kaisha Komatsu Seisakusho, Tokyo, Japan

[21] Appl. No.: 505,342

[22] PCT Filed: Mar. 15, 1995

[86] PCT No.: PCT/JP94/00412

§ 371 Date: Aug. 24, 1995

§ 102(e) Date: Aug. 24, 1995

[87] PCT Pub. No.: WO94/21404

PCT Pub. Date: Sep. 29, 1994

[30] Foreign Application Priority Data

Mar. 16, 1993 [JP] Japan ..... 5-055262
Apr. 28, 1993 [JP] Japan ..... 5-102046

[51] Int. Cl.[6] ..... B21D 43/05

[52] U.S. Cl. ..... 72/405.1; 72/405.11; 198/621.1

[58] Field of Search ..... 72/405.16, 405.13, 72/405.11, 405.1, 405.01; 198/621.1–621.4; 414/752

[56] References Cited

U.S. PATENT DOCUMENTS

| | | | |
|---|---|---|---|
| 4,540,087 | 9/1985 | Mizumoto . | |
| 4,807,456 | 2/1989 | Shiraishi | 72/405.1 |
| 4,995,505 | 2/1991 | Takahashi | 72/405.1 |
| 5,148,697 | 9/1992 | Shiraishi | 72/405.1 |
| 5,269,168 | 12/1993 | Ogawa | 72/405.1 |
| 5,385,040 | 1/1995 | Michael | 72/405.1 |

FOREIGN PATENT DOCUMENTS

| | | | |
|---|---|---|---|
| 0 315 381 A2 | 5/1989 | European Pat. Off. . | |
| 0 507 098 A1 | 10/1992 | European Pat. Off. . | |
| 56-126144 | 10/1981 | Japan . | |
| 61-283426 | 12/1986 | Japan | 72/405.01 |
| 62-161436 | 7/1987 | Japan | 72/405.01 |
| 63-194831 | 8/1988 | Japan . | |
| 63-47525 | 9/1988 | Japan . | |
| 1-37784 | 11/1989 | Japan . | |
| 2-35380 | 9/1990 | Japan . | |
| 1279722 | 12/1986 | U.S.S.R. | 72/405.01 |
| 2227697 | 8/1990 | United Kingdom | 72/405.1 |

*Primary Examiner*—Daniel C. Crane
*Attorney, Agent, or Firm*—Frishauf, Holtz, Goodman, Langer & Chick

[57] ABSTRACT

A transfer feeder which comprises: a pair of lifting beams (9) which are so disposed as being parallel to each other and extending in a workpiece conveying direction; a lifting mechanism (10) for driving the said pair of the lifting beams in upward and downward directions; a plurality of pairs of cross bar carriers (15) which are so arranged on the said pair of the lifting beams as to be spaced apart from, and connected with, one another and be displaceable in the said workpiece conveying direction; a cross bar (16) that is transversely bridged across a said pair of those cross bar carriers as afore-said which are juxtaposed with each other, and that has a workpiece attracting means (19) attached thereto; and a feed mechanism (22) for driving the said cross bar carriers in a feed direction, the said transfer feeder being characterized in that at least the said lifting mechanism is provided with its drive source that is constituted by a servo-motor (11). According to this construction, since the lifting beam is driven by a servo-motor, such cross bars which are multiple can be displaced in any movement pattern as desired, thus enabling a variety of movement patterns to be readily obtained as desired. Furthermore, as an individual cam is not required for each individual movement pattern to be established, it follows that a drastic simplification of the drive mechanism is hereby achieved.

6 Claims, 8 Drawing Sheets

TRANSFER FEEDER

This application is a 371 of PCT/JP94/00412 filed Mar. 15, 1994.

TECHNICAL FIELD

The present invention relates to a transfer feeder that employs a suction-type conveying system.

BACKGROUND ART

In the traditional art, it is known that a transfer press has been provided with a transfer feeder for carrying a workpiece into and out of a press system, or for sequentially conveying workpieces into successive working stations.

Conventionally, the transfer feeder for conveying the workpieces has been provided with a pair of transfer bars which are operable to move in two-dimensional or three-dimensional directions, the transfer feeder having been so constructed as to be driven by a cam rotated by the power that is taken out from the press system.

In the conventional transfer feeder employing the cam-drive system, however, the movement of the transfer bars is eventually determined by a profile of the cam. Accordingly, a problem has then arisen such that the movement pattern is not readily variable in accordance with the workpieces which are being conveyed. On the other hand, if the movement patterns of the transfer bars are made variable, a plurality of cams have been required in accordance with the movement patterns which are to be altered from one to another. This requirement has made the drive mechanism unduly complex and the entire system prohibitively expensive, and has involved various inconveniences including, among others, the restriction imposed on the number or the movement patterns that can variably be chosen by selecting the number of cams.

SUMMARY OF THE INVENTION

With the foregoing points taken into account and in order to eliminate such conventional disadvantages, a first object of the present invention is to provide a transfer feeder by which a desired movement pattern is made readily obtainable in accordance with a workpiece that is being conveyed, and which is yet of a simplified construction.

Accordingly, in order to achieve the above-mentioned first object, there is provided, in accordance with a first embodiment of the present invention, a transfer feeder which comprises:

- a pair of lifting beams which are so disposed as being parallel to each other and extending in a workpiece conveying direction;
- a lifting mechanism for driving the said pair of the lifting beams in upward and downward directions;
- a plurality of pairs of cross bar carriers which are so arranged on the said pair of the lifting beams as to be displaceable in the said workpiece conveying direction;
- a cross bar that is transversely bridged across a said pair of those cross bar carriers as afore-said which are opposite to each other, and that has a workpiece attracting means attached thereto; and
- a feed mechanism for driving the said cross bar carriers in a feed direction, the said transfer feeder being characterized in that:
- at least the said lifting mechanism is provided with its drive source that is constituted by a servo-motor.

According to this construction with the drive source of at least the lifting mechanism being constituted by a servo-motor, such cross bars as mentioned above can be displaced to provide a desired movement pattern thereof. Accordingly, a variety of movement patterns of the cross bars are made readily obtainable as desired. Furthermore, since an individual cam is not required for each individual movement pattern to be established, it follows that a drastic simplification of the drive mechanism is hereby achieved.

The feed mechanism may have its drive source which is constituted by the power that is taken out from the press system. In this instance, because the feed in the feed direction is mechanically interlocked with the press system, it is apparent that there is no fear that due to an instantaneous stop, a forming operation may be performed with any cross bar closed up in a die. Consequently, the cross bars and the dies should be prevented, without fail, from being damaged.

Also, the feed mechanism may have its drive source which is constituted by a servo-motor. In this instance, since the vibrations of the cross bars that may be generated in the conveyance of a workpiece is reduced as compared with the conventional cam-drive system, it is noted that any feed failure and noise can be prevented.

It should also be noted that a transfer feeder according to the present invention may be provide for a modular type transfer press in which each of multiple press units is independently provided for each of multiple, successive working stations. Thus, a lifting mechanism may be arranged between adjacent press units as afore-said.

Further, support beams for supporting the above-mentioned press units may be provided with feed mechanisms as afore-mentioned. It will be readily apparent, therefore, that the present invention enables the workpiece output apparatus to convey completed workpieces to be readily installed at the downstream side of the press system.

BRIEF EXPLANATION OF THE DRAWINGS

The present invention will better be understood from the following detailed description and the drawings attached hereto showing certain illustrative embodiments of the present invention. In this connection, it should be noted that such embodiments as illustrated in the accompanying drawings are intended in no way to limit the present invention, but to facilitate the explanation and understanding thereof.

In the accompanying drawings.

BEST MODES FOR CARRYING OUT THE INVENTION

Hereinafter, the constructions of transfer feeders each according to a certain suitable embodiment of the present invention will be described with reference to the drawings attached hereto.

Figure 1:
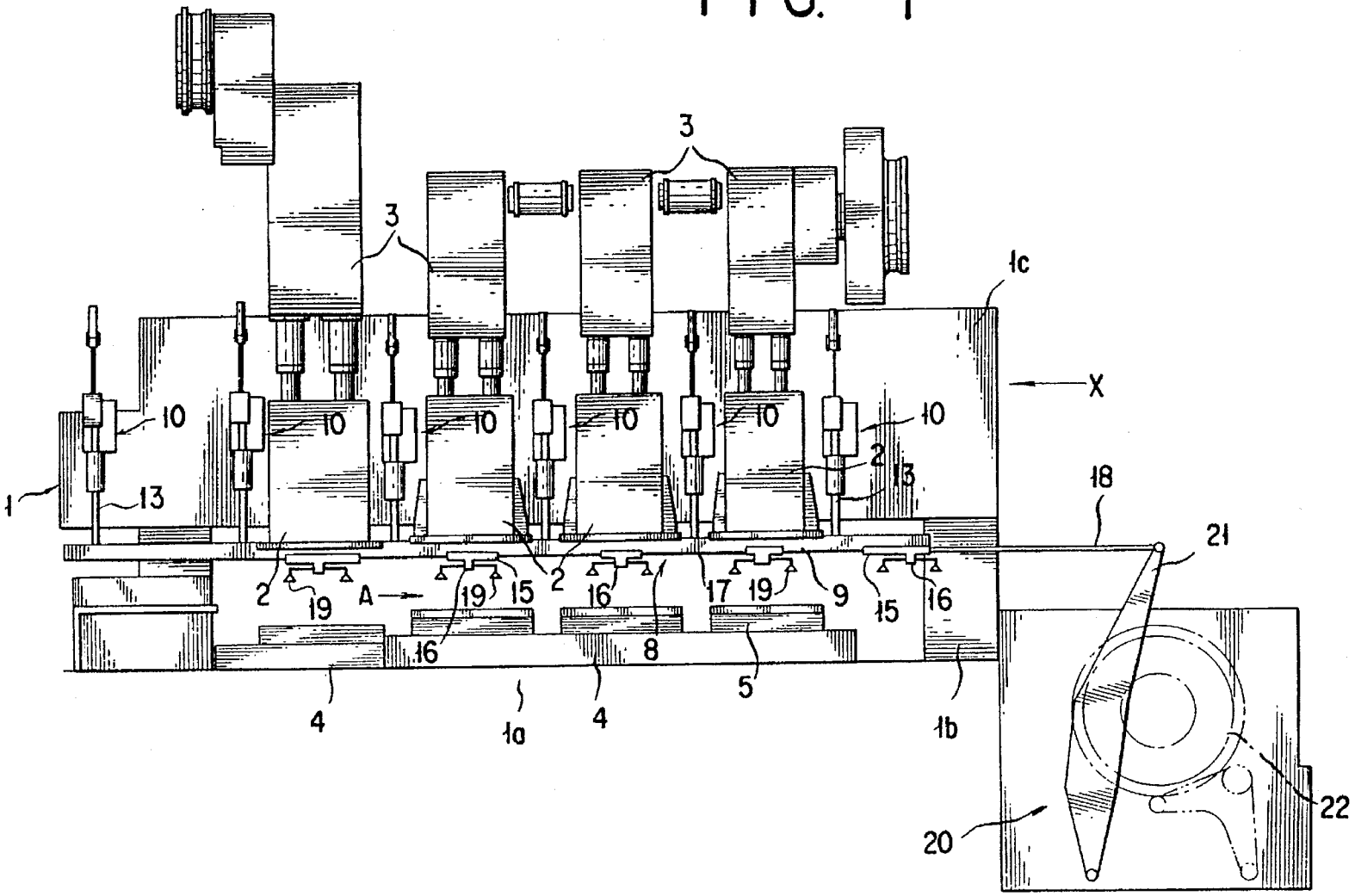
FIG. 1 is a front view illustrating a transfer press that is equipped with a first embodiment of the transfer feeder according to the present invention.
Figure 2:
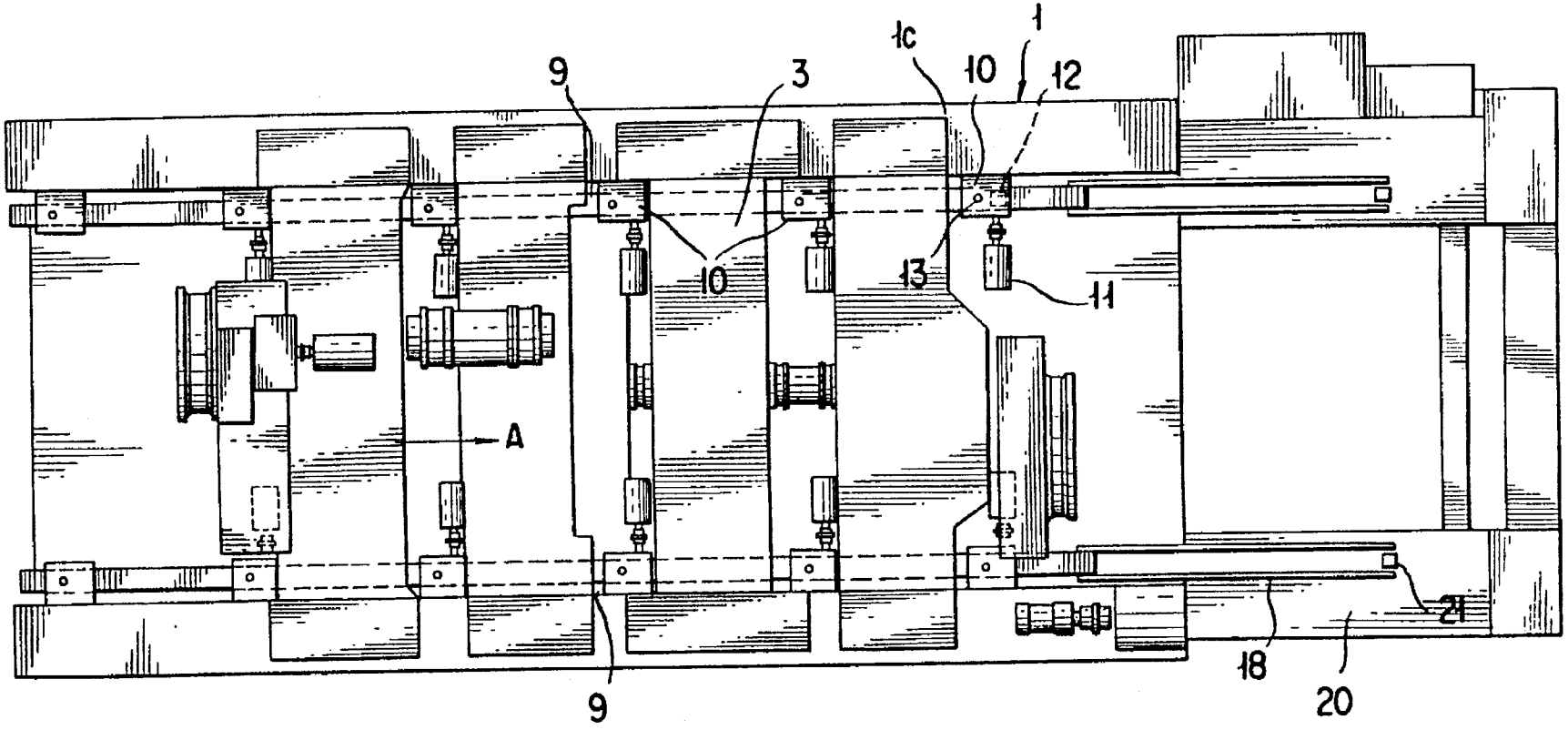
FIG. 2 is a plan view illustrating a transfer press that is equipped with the above-mentioned first embodiment of the invention.
Figure 3:
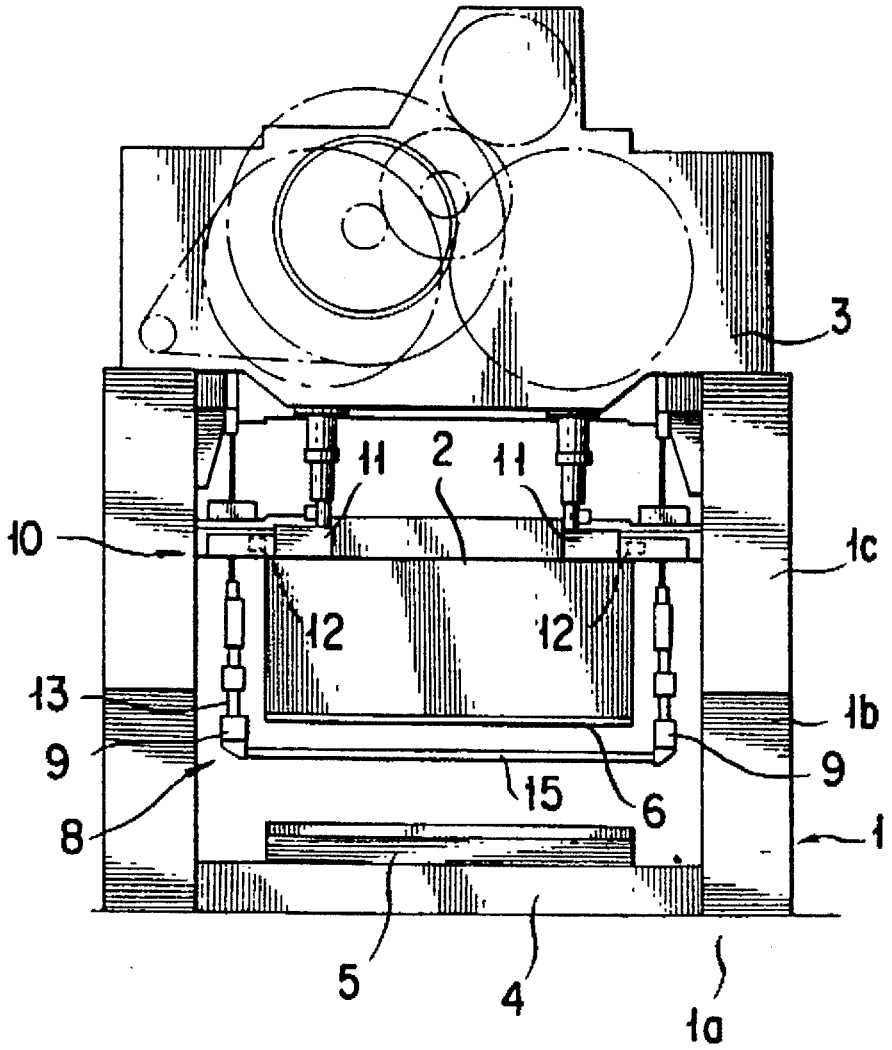
FIG. 3 is an elevational view of the transfer press as seen in the direction of the arrow X in FIG. 1.

FIGS. 1 to 3 illustrate a first embodiment of the transfer feeder according to the present invention.

In the Figures, the numeral 1 designates a a modular type transfer press system in which slides 2 and their drive mechanisms 3 are assigned to multiple working stations, respectively. The transfer press system 1 includes a pair of uprights 1*b* standing upwards from a bed 1*a* and spaced apart from each other back and forth as well as leftwards and rightwards, and which has a pair of beams 1*c* disposed thereon, respectively, spaced apart from each other back and forth and so arranged as being parallel to each other and extending in a workpiece conveying direction A. Between these beams 10, there are the multiple drive mechanisms 3 bridged transversely for their respective working stations. Under these slide drive mechanisms 3, there are so disposed the slides 2 as being movable in upward and downward directions.

Further, under the respective slides 2 there lie a plurality of, say, a pair of, moving bolsters 4 which are capable of insertion into, and withdrawal from, the press system 1. And, between lower dies 5 mounted on the these moving bolsters 4 and upper dies 6 attached to the respective lower surfaces of the above-mentioned slides 2, the press system is so constructed that a pressforming operation may be performed.

On the other land, the numeral 8 in FIG. 1 designates a transfer feeder which is provided in the afore-mentioned press system 1 with a pair of lifting beams 9 that are so arranged as being parallel to each other and extending in the workpiece conveying direction A. These lifting beams 9 are suspended by a plurality of lifting mechanisms 10 which lie upwards, are mounted on the beams 1*c* and so disposed that they may be positioned between the slide drive mechanisms 3.

Each of the above-mentioned lifting mechanisms 10 is provided with a pinion 12 rotated by a servo motor 11 and a rack bar 13 which is in engagement with the pinion 12 and which is capable of displacement in upward and downward directions. A plurality of portions of the lifting beams 9 are supported at the lower ends of such rack bars 13 which are plural. And, the lifting beams 9 are so arranged that they may be driven up and down by such servo-motors 11 which are also plural in synchronism with the operation of the press system 1.

The lower end of each of the afore-mentioned lifting beams 9 has a plurality of cross bar carriers attached thereto which are spaced from one another in the workpiece conveying direction A and are arranged so as to be displaceable in workpiece conveying direction. A cross bar 16 is arranged so as to transversely bridge those cross bar carriers 15 which are opposite to each other and to extend orthogonally to the workpiece conveying direction A. Such cross bars 16 which are plural have suction means 19 such as suction cups attached thereto for attracting the workpieces to them.

The cross bar carriers 15 are interconnected by a connecting rod 17 so that they may be displaced in the feed direction at the same time, whereas the cross bar carriers 15 located downstream are connected via a connecting rod 18 to a Feed lever 21 of a feed mechanism 20.

The above-mentioned feed mechanism 20 is provided with a feed cam 22. By rocking the feed lever 21 by means of this feed cam 22 which is rotated by the power that is taken out from the press system, each cross bar carrier 15 is adapted to be drivable in the feed direction.

In connection with the foregoing, it should also be noted that a positive-motion cam is used for the above-mentioned feed cam 22 and that an energizing reaction cylinder designed to ensure that the rocking lever 21 may not be detached from the feed cam 22 and so forth are provided as well.

Next, the operation of the first embodiment of the invention will be described.

First, the lifting beams 9 will be moved in upward and downward directions via the rack bars 13 by the servo-motors 11 whose rotations are controlled in synchronism with the operation of the press system 1. At the same time, the cross bar carriers 15 will be reciprocated by the feed mechanism 20 in the feed direction to sequentially convey into the successive working stations the workpieces which are attracted to the suction means 19 such as the suction cups attached to the cross bars 16.

Figure 4A:
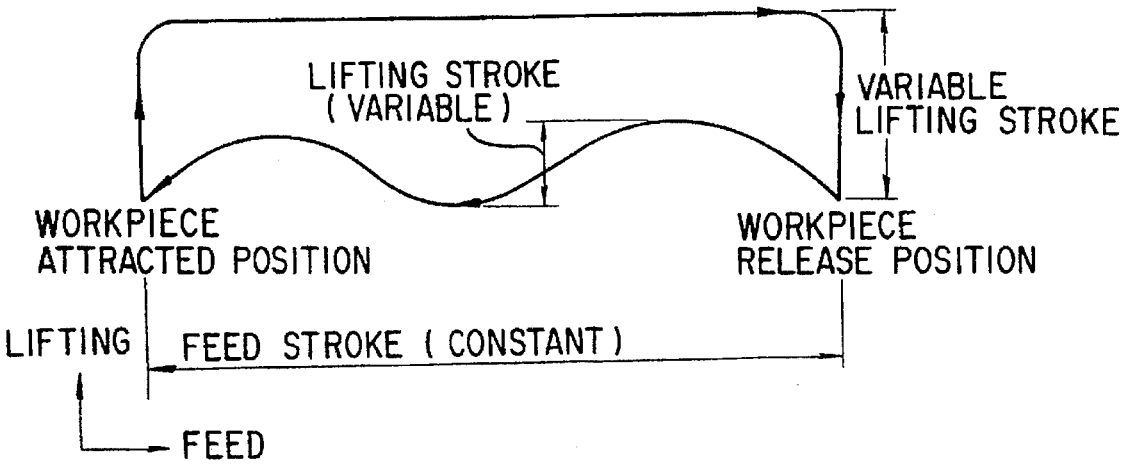
FIGS. 4A and 4B are functional explanatory diagrams illustrating the afore-mentioned first embodiment of the invention.
Figure 4B:
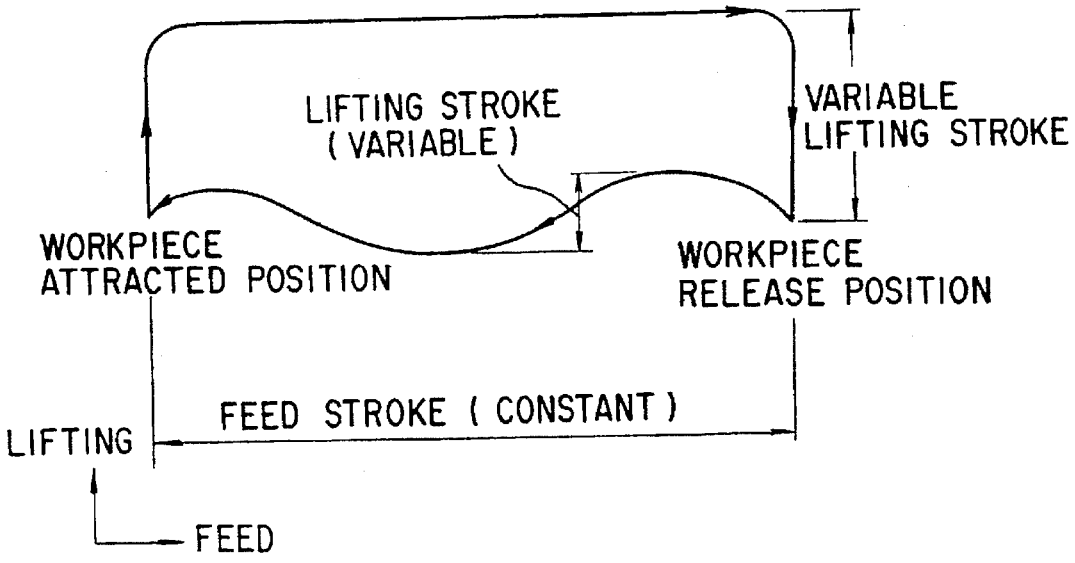

At that time, by controlling the servo-motors 11 while the workpieces are being conveyed in order to prevent a workpiece and a die from interfering with each other, the cross bars 16 can be displaced in any movement pattern as desired in dependence upon the configuration of the workpieces, as shown in the graphs of FIGS. 4A and 4B, thereby enabling the workpieces to be conveyed without causing any interference between the dies and the workpieces.

As has been described in the foregoing, the first embodiment of the invention provides a construction in which the lifting beams are driven in upward and downward directions by the lifting mechanisms of which the drive sources are the servo-motors, whereas the cross bar carriers which are transversely bridged by the cross bars are driven in the feed direction in which the cam is driven. Accordingly, by controlling the servo-motors, the cross bars can be displaced in any arbitrary pattern as desired in accordance with the particular configuration or the like of a workpiece to be formed.

Further, a complex drive mechanism is herein made unnecessary to obtain a desired movement pattern. A vast cost reduction of the transfer feeder is thus achieved hereby.

Also, because a cam-drive system is employed in which the feed direction is interlocked mechanically with the press system, in this embodiment it will be apparent that there is no fear that a forming operation is initiated in a state in which due to an instantaneous stop, the cross bars are closed up in the dies themselves. Accordingly, it is made possible to prevent, without fall, the cross bars or the dies being damaged.

Next, a second embodiment of the present invention will be described in detail.

Figure 5:
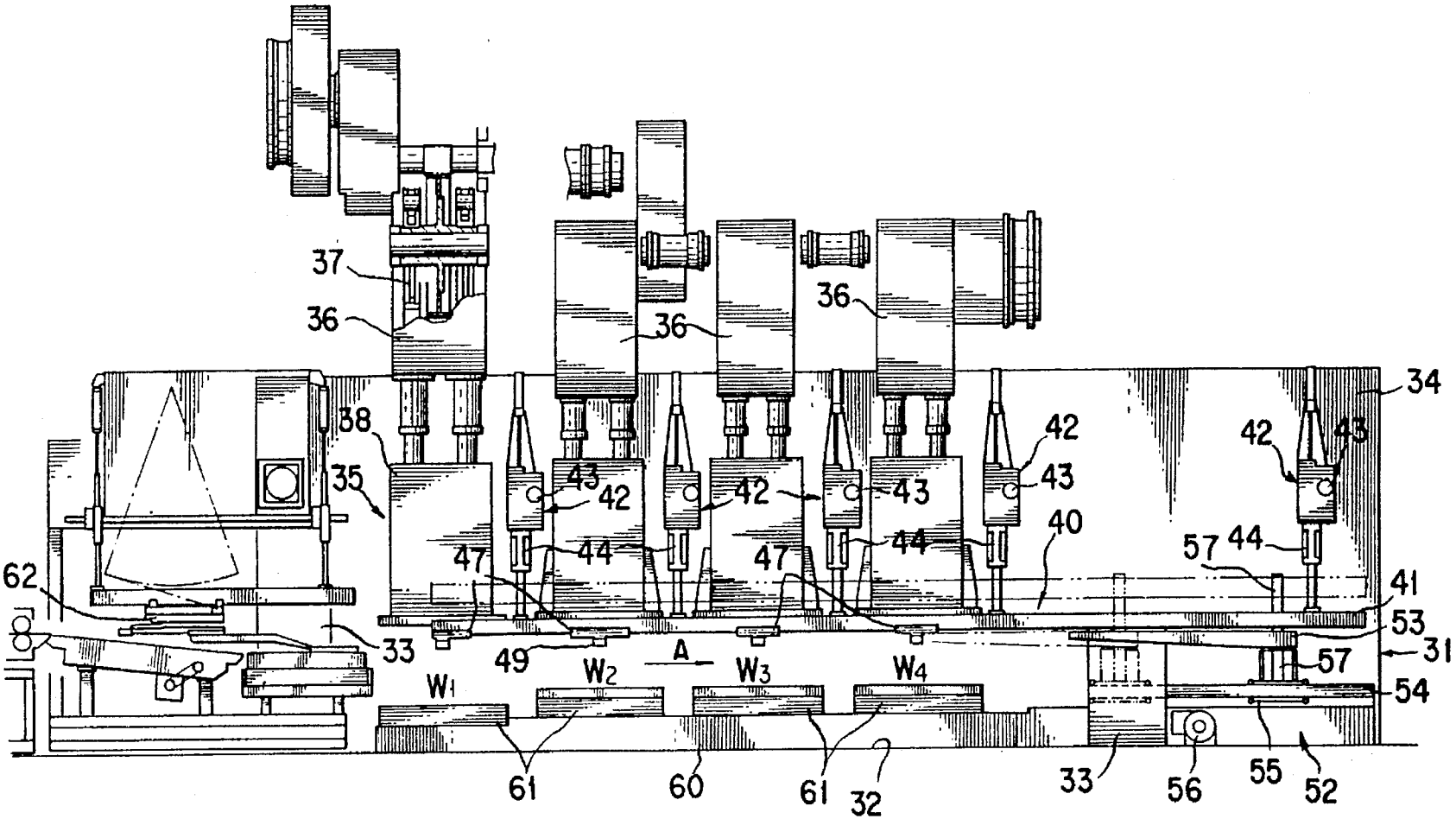
FIG. 5 is a front view illustrating a transfer press that is equipped with a second embodiment of the transfer feeder according to the present invention.
Figure 6:
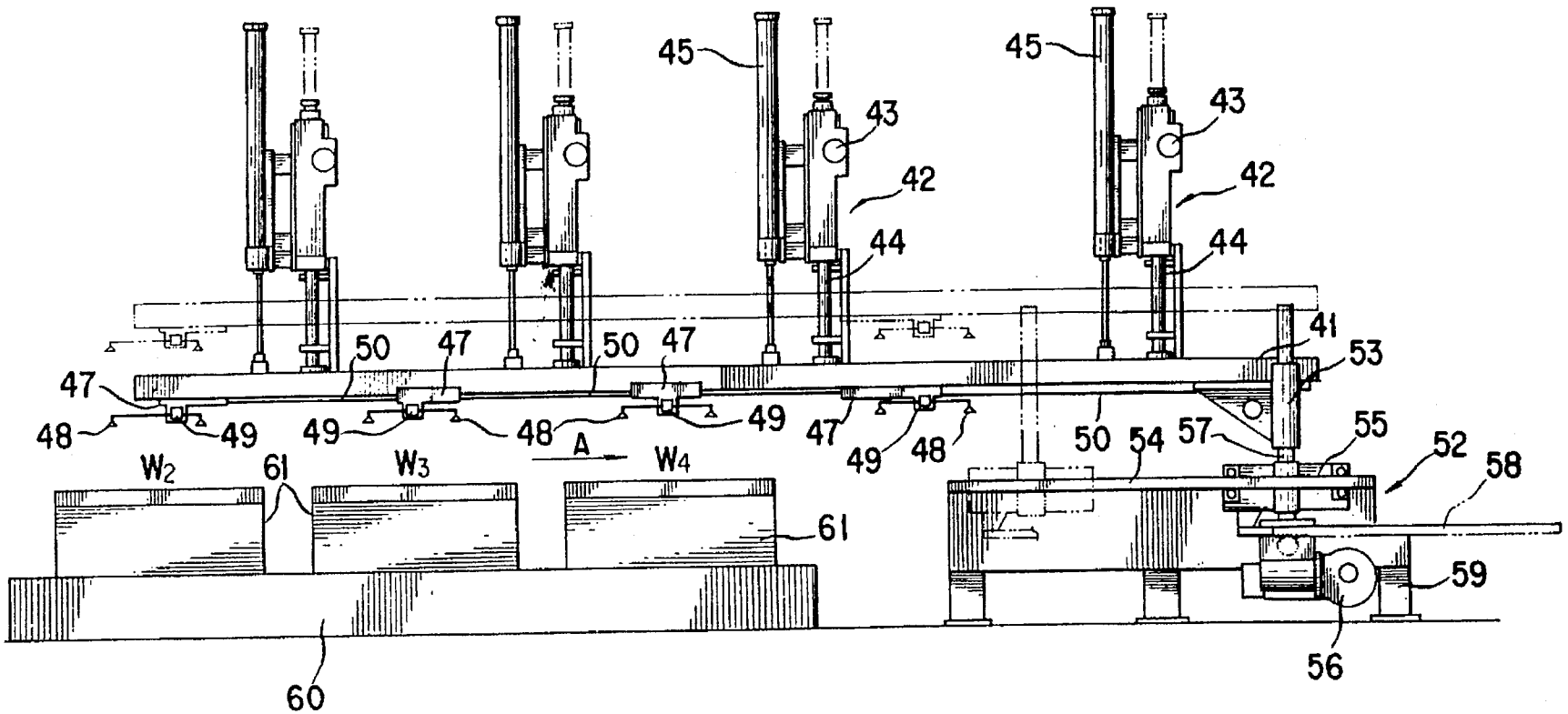
FIG. 6 is a front view of the above-mentioned second embodiment of the invention.

FIGS. 5 and 6 illustrate a modular type transfer press system in which each of multiple press units is independently provided for each of multiple, successive working stations and which is equipped with a transfer feeder that constitutes the second embodiment of the present invention.

In the Figures, the numeral 31 designates a press system which includes a bed 32. Standing upwards from the bed 32 are a plurality of uprights 33 which are spaced apart from one another back and forth as well as leftwards and rightwards. The upper ends of uprights 33 at the front side and the upper ends of uprights 33 at the rear side are transversely bridged by a pair of support beams 34, respectively, which are so disposed as to extend parallel to a workpiece conveying direction A. And, between these support beams 34, there are arranged multiple press units 35 for multiple working stations W1 to W4, respectively.

The above-mentioned press units 35 are each provided thereabove with a crown 36 within which a slide drive mechanism 37 is received. By means of such slide mechanisms 37 which are plural, slides 38 disposed under such crowns 36 which are also plural are so constructed as to be driven in upward and downward directions.

On the other hand, the numeral 40 in the Figures represents a transfer feeder which is provided in the press system 31.

The above-mentioned transfer feeder 40 is provided with a pair of lifting beams 41 which are so disposed as being parallel to each other and extending in the workpiece conveying direction A. The lifting beams 41 are so arranged that they may be moved in upward and downward directions by a plurality of lifting mechanisms 42.

Such a lifting mechanism 42 as mentioned above is mounted on the beam 34 so that it may be positioned between the adjacent press units 35, and has a lifting motor 43 which is constituted by a servo-motor that is provided independently for each lifting mechanism 42.

And, such lifting motors 43 which are plural have each a pinion that is in engagement with a rack which is formed on a lifting spindle 44 so that the latter may be displaceable by the respective lifting motor 43 in upward and downward directions. Moreover, the upper surface of each lifting beam 41 as afore-said is secured to the lower end of the respective lifting spindle 44.

In this connection, it should be noted that the numeral 45 in the Figures designates balancing cylinders which are adapted to support the load of the lifting beams 41. and are each provided for each individual lifting mechanism 42.

On the other hand, the above-mentioned lifting beams 41. are provided at their respective lower ends with a plurality of cross bar carriers 47 which are spaced apart from one another in the workpiece conveying direction A.

And, each pair of those cross bar carriers 47 as above-mentioned which are opposite to each other in a back and forth direction are transversely bridged by a cross bar 49 that has a suction means 48 such as a pair of suction cups attached thereto for attracting each individual workpiece.

Also, those cross bar carriers 47 which are spaced apart from one another in the workpiece conveying direction A are interconnected by a connecting rod 50. Further, time downstream end portion of the connecting rod 50 is connected to a carrier 53 which is driven in the workpiece conveying direction A by a feed mechanism 52 that is arranged at the downstream side of the press system 31.

The above-mentioned feed mechanism 52 is disposed at the downstream side of the press system 31, whereas a feed carrier 55 is supported on a guide rail 54 which is disposed on the upper portion of a pedestal 59 of the said feed mechanism 52.

The above-mentioned feed carrier 55 is connected to a rack 58 which is displaced in the workpiece conveying direction A by a feed motor 56 that is constituted by a servo-motor and is arranged at the lower portion of the pedestal 59*a*. Thus, the feed carrier 55 is adapted to be reciprocatable by the feed motor 56 in the workpiece conveying direction A along the guide rail 54.

The afore-mentioned feed carrier 55 is provided with an up-standing guide post 57 having its upper end to which is connected the carrier 53 that is supported at the downstream end of the lifting beam 41 so that each cross bar carrier 47 may be displaced conjunction with the reciprocating movement of the afore-mentioned feed carrier 55.

In this connection, it should be noted that the reference numeral 60 in the Figures designates a moving bolster, which is capable of insertion into, and withdrawal from, the press system 31 and on which dies 61 are mounted for the respective working stations W1 to W4.

Also, as will be noted, the reference numeral 62 in the Figures designates a workpiece conveying apparatus which is disposed at the upstream side of the press system 31.

Next, the operation of the second embodiment of the invention will be described.

First, after a workpiece to be formed is carried into the press system 31 from the workpiece conveying apparatus 62 which is disposed at the upstream side, the workpiece will be attracted by the suction means 48 which is attached to the particular cross bar 49 that is disposed at the most upstream side.

And, after the lifting beams 41 are elevated by the lifting mechanisms 42 to a predetermined height, each individual cross bar carrier 47 will be displaced towards the downstream side by the feed mechanism 52. And, after a predetermined pitch transferring of each individual cross bar carrier, the lifting beams 41 will be returned downwards by the lifting mechanisms 42 to locate a new workpiece in the first working station W1. And, the workpieces which have completed their forming operations in the working stations W1 to W4 will be sequentially conveyed or transferred to the next successive working stations W2 to W4.

Subsequently, the foregoing operations will be repeated to transfer the workpieces to the successive working stations W1 to W4. In this embodiment, because the lifting mechanisms 42 and the feed mechanism 52 are adapted to incorporate servo-motors, it is made possible to make the lifting height, the feed pitch and so forth freely variable as desired.

As has been described in the foregoing, the present invention provides a construction in which the lifting motors and the feed motor are constituted by servo-motors. Accordingly, by virtue of the fact that the lifting height, the feed pitch and so forth are made readily variable as desired in accordance with workpieces to be formed, the versatility of a transfer feeder is hereby largely enhanced. Further, because the lifting mechanisms and the feed mechanism are structurally simplified as compared with the conventional cam-drive system, the system itself hereof is made much less costly.

In addition, by using servo-motors as the drive sources, the vibrations of a cross bar generated in conveying the workpieces can be much reduced as compared with what is described as the conventional cam-drive system. Accordingly, any feed failure and noise are drastically prevented herein.

Figure 7:
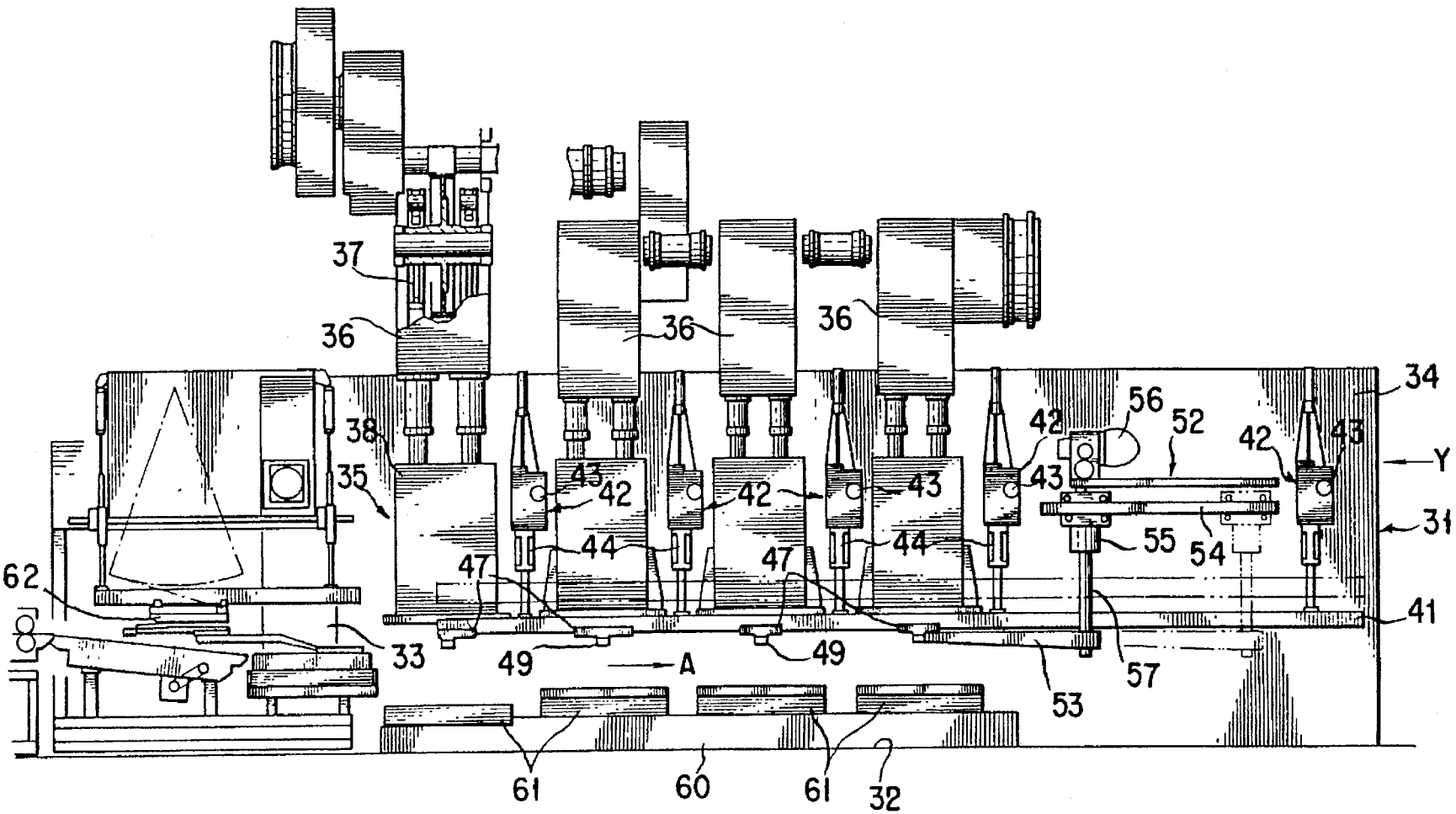
FIG. 7 is a front view illustrating a transfer press that is equipped with a third embodiment of the transfer feeder according to the present invention.
Figure 8:
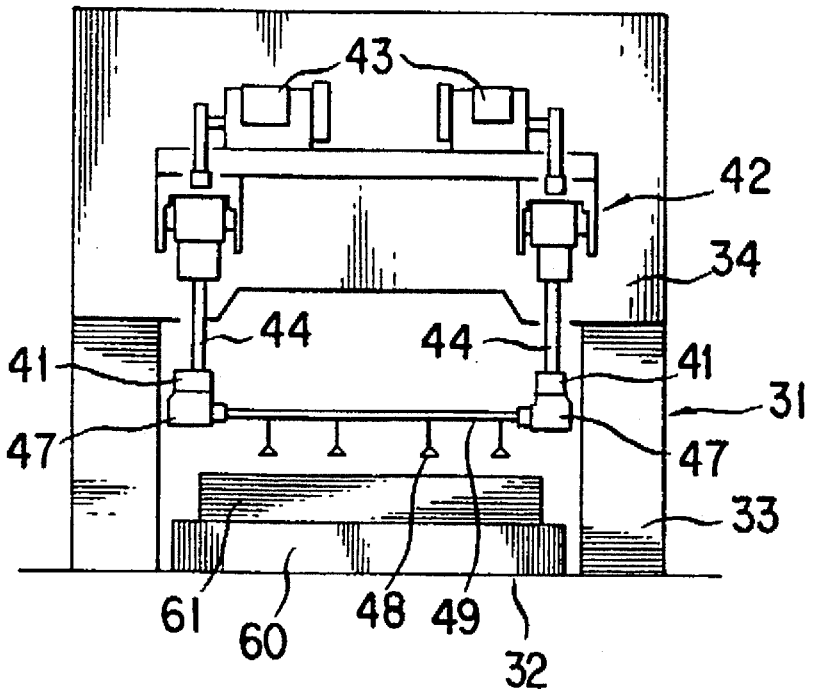
FIG. 8 is an elevational view of the transfer press as seen in the direction of the arrow Y in FIG. 7.

While according to the second embodiment the feed mechanism 52 is shown as being mounted on the bed 32 at the downstream side of the press system 31, it may alternatively be mounted at the downstream side of the support beam 34 according to a third embodiment of the present invention as shown in FIGS. 7 and 8. Such a modification has an advantage in that an output apparatus for conveying out the forming-completed workpieces is readily installable in a space at the downstream side.

While the present invention has hereinbefore been described with respect to certain illustrative embodiments thereof, it will readily be appreciated by those skilled in the art to be obvious that many alterations thereof, omissions therefrom and additions thereto can be made without departing from the essence and the scope of the present invention. Accordingly, it should be understood that the present invention is not limited to the specific embodiments thereof set out above, but includes all possible embodiments thereof that can be made within the scope with respect to the features specifically set forth in the appended claims and encompasses all equivalents thereof.

INDUSTRIAL APPLICABILITIES

As bas been described hereinbefore, the transfer feeder according to the present invention is extremely useful as a transfer feeder, especially one that employs a suction-type conveying system.

What is claimed is:

1. A transfer feeder for a modular type transfer press system in which each of multiple unitary press units of a press system is independently provided for each of multiple unitary working stations, respectively, said transfer feeder comprising:

a pair of lifting beams arranged in parallel to each other, each of said lifting beams extending in a workpiece conveying direction continuously through said multiple unitary press units and said multiple unitary working stations;

a lifting mechanism for driving said pair of lifting beams in upward and downward directions;

a plurality of pairs of cross bar carriers arranged relative to said pair of lifting beams so as to be spaced apart from, and coupled to, one another and so as to be displaceable in said workpiece conveying direction;

a cross bar that is transversely bridged across a pair of said cross bar carriers which are arranged opposite to each other, said cross bar having a workpiece attracting device attached thereto; and a feed mechanism for driving said cross bar carriers in a feed direction;

said lifting mechanism comprising multiple unitary lifting units each of which is provided with a respective drive source that includes a servo-motor which is individually provided between adjacent unitary press units and which is adapted to be individually controlled to allow a particular workpiece for a particular unitary press unit associated therewith to be displaced in any arbitrary pattern as desired in accordance with press parameters including a particular configuration of the workpiece to be formed.

2. The transfer feeder as set forth in claim 1, wherein said feed mechanism comprises a feed cam for driving said cross bar carriers, and a drive source which derives power from the press system.

3. The transfer feeder as set forth in claim 1, wherein said drive source of said feed mechanism includes a servo-motor which is adapted to be controlled in conjunction with said servo-motors of said unitary lifting units to allow press movement parameters including a lifting height and a feed pitch for the workpiece to be freely variable.

4. The transfer feeder as set forth in claim 1, wherein said feed mechanism is arranged on a support beam for supporting said press units.

5. The transfer feeder as set forth in claim 2, wherein said feed mechanism is arranged on a support beam for supporting said press units.

6. The transfer feeder as set forth in claim 3, wherein said feed mechanism is arranged on a support beam for supporting said press units.

* * * * *

UNITED STATES PATENT AND TRADEMARK OFFICE

CERTIFICATE OF CORRECTION

PATENT NO. : 5,649,443

DATED : July 22, 1997

INVENTOR(S) : Kazuhiko SHIROZA et al

It is certified that error appears in the above-indentified patent and that said Letters Patent is hereby corrected as shown below:

On the Title Page, under Section [22] PCT Filed,

Change "Mar. 15, 1995" to --Mar. 15, 1994--.

Signed and Sealed this

Seventeenth Day of February, 1998

*Attest:*

*Attesting Officer*

BRUCE LEHMAN

*Commissioner of Patents and Trademarks*